US010821457B2

(12) United States Patent
Tecchiolli et al.

(10) Patent No.: US 10,821,457 B2
(45) Date of Patent: Nov. 3, 2020

(54) MANUAL PUMP WITH SAFETY ELEMENT

(71) Applicant: Coster Tecnologie Speciali S.p.A., Calceranica al Lago (IT)

(72) Inventors: Alfeo Tecchiolli, Meano (IT); Giancarlo Fontanari, Altopiano Della Vigolana (IT)

(73) Assignee: COSTER TECHNOLOGIES SPECIALI S.P.A., Calceranica al Lago (TN) (IT)

( * ) Notice: Subject to any disclaimer, the term of this patent is extended or adjusted under 35 U.S.C. 154(b) by 0 days.

(21) Appl. No.: 16/512,998

(22) Filed: Jul. 16, 2019

(65) Prior Publication Data

US 2020/0023394 A1 Jan. 23, 2020

(30) Foreign Application Priority Data

Jul. 19, 2018 (IT) ..... 102018000007341

(51) Int. Cl.
*B05B 11/00* (2006.01)

(52) U.S. Cl.
CPC ..... *B05B 11/3059* (2013.01)

(58) Field of Classification Search
CPC ..... B05B 11/3059
USPC ..... 222/153.13, 153.14, 384, 402.11
See application file for complete search history.

(56) References Cited

U.S. PATENT DOCUMENTS 3,590,691 A * 7/1971 Magers ..... B05B 11/3059 92/23
4,377,106 A 3/1983 Workman et al.
4,384,660 A * 5/1983 Palmisano ..... B05B 11/3059 222/153.07
4,479,589 A * 10/1984 Ford ..... A47K 5/1201 222/153.13
5,975,370 A * 11/1999 Durliat ..... B05B 11/0027 222/153.06
6,971,381 B2 * 12/2005 Langford ..... A61M 15/009 128/200.23
8,602,269 B2 * 12/2013 Alluigi ..... B05B 11/3025 222/321.8
8,651,335 B2 * 2/2014 Faneca Llesera ... B05B 11/0027 222/153.06
2010/0237102 A1 * 9/2010 Margheritis ..... B65D 83/7575 222/153.06
2018/0178233 A1 * 6/2018 Goettke ..... B05B 11/306

* cited by examiner

*Primary Examiner* — Vishal Pancholi
(74) *Attorney, Agent, or Firm* — King & Schickli, PLLC

(57) ABSTRACT

Manual operated pump for the delivery of a fluid, equipped with a main part comprising a dispenser coupled with a hollow stem through which the fluid is dispensed, and a ring nut for fastening the pump to a container for containing fluid to be dispensed, the pump having a safety element, configured to be snap-fitted onto a cylindrical part of the dispenser through an opening therein so as to be interposed between at least one surface of the dispenser and the ring nut, thereby preventing the dispenser from moving closer to the ring nut in the event of an impact during transportation, the safety element featuring ribs parallel to the axis of the cylindrical part, and the main part of the pump comprises projections for cooperating with the ribs to limit or prevent rotation of the safety element relative to the main part.

10 Claims, 2 Drawing Sheets

MANUAL PUMP WITH SAFETY ELEMENT

This application claims priority to Italian Application No. 102018000007341 filed on Jul. 19, 2018, which is incorporated by reference.

FIELD OF THE INVENTION

The present invention relates to a manual pump equipped with a safety element.

In particular, it refers to a manual pump for dispensing a fluid contained within a container to which the pump is coupled. The pump comprises a safety element which keeps the latter intact should it fall during transportation.

BACKGROUND ART

An annular safety element is known, for example from JP2013095462 A1, which is snap-fitted between a dispenser and a ring nut for fastening a pump to a container.

It has been established that, upon undergoing severe drop tests (such as those envisaged for e-commerce, with the container full), the safety element described in the Japanese document comes off, leaving the pump without protection.

Moreover, the same stresses that cause the safety element to come off can cause damage to the pump, since not properly protected thereby, especially in the event of impacts which impose strain on the dispenser (and therefore the pump stem) resulting in deflection.

Also, the device described in U.S. Pat. No. 4,377,106 is known from the prior art.

SUMMARY OF THE INVENTION

The object of the present invention is to provide a pump with a safety element, which minimises the possibility of damage to the pump in the event of impacts, including therein repeated impacts.

This and other objects are achieved by means of a manual pump with a safety element according to the technical teachings of the claims annexed hereto.

BRIEF DESCRIPTION OF THE FIGURES

Further characteristics and advantages of the invention will become clearer in the description of a preferred but not exclusive embodiment of the device, illustrated—by way of a non-limiting example—in the drawings annexed hereto, in which.

DETAILED DESCRIPTION OF THE INVENTION

With reference to the figures stated, reference number 1 is used to denote, as a whole, a manual pump with a safety element.

Figure 1:
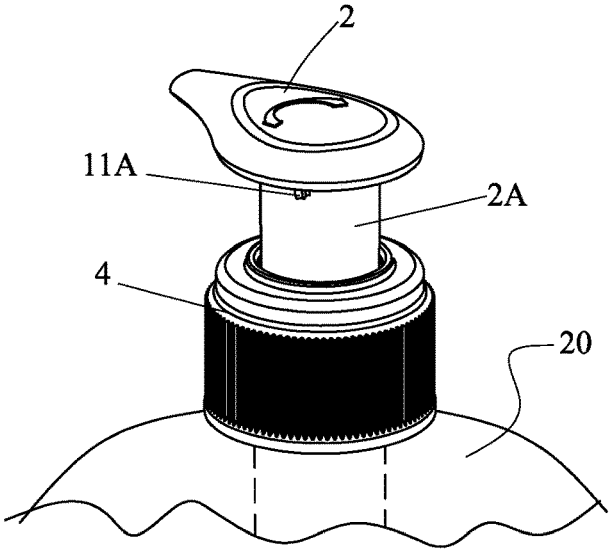
FIG. 1 is a rear perspective view of a main part of the pump, secured to a container shown partially.

The pump 1, shown without a safety element in FIG. 1, is of a manually operated type and is configured to dispense a fluid present within a container 20 which can be coupled with the pump by means of a ring nut 4.

In this document, the term "fluid" means any substance that can be processed by a manual pump, such as a liquid for cosmetic purposes (soap, make-up remover, etc.), medical purposes, or for household cleaning etc.

As can be seen in FIG. 1, the pump comprises a main part which, in addition to the ring nut 4, further comprises a dispenser 2 (which, in this case, has a spout configuration, but obviously can have any other appropriate configuration) hermetically coupled with a hollow pump stem 3. The hollow stem 3 is shown, with a dashed line, in FIG. 7.

During use, when the dispenser is pressed towards the ring nut 4, the pump applies pressure to the fluid in a commonly known manner and the fluid flows through the hollow stem 3 to be dispensed through a suitable opening 21 in the spout.

As mentioned above, the pump is fastened (hermetically) to the container by means of the ring nut 4, which may feature a thread that cooperates with a suitable counter-thread on the neck of the container. Obviously, this configuration is only one of the possible configurations, since the ring nut can be fastened to the neck of the container 20 in another commonly known way (for example by means of a snap-fitting, etc.).

In the example shown, the pump is of the "open/close" type. Indeed, the spout may be set in at least two operating positions; in the first, spout travel is locked (for example by a stop on the ring nut), while in the second one (for example when the spout is rotated by 90° with respect to the previous position) travel—and therefore also dispensing—is enabled.

To protect the pump from breakage due to any impacts which may occur during transportation (for example with the container 20 full), there is a safety element 5 which can be snap-fitted onto a cylindrical part 2A of the dispenser, also known as the drum.

Figure 2:
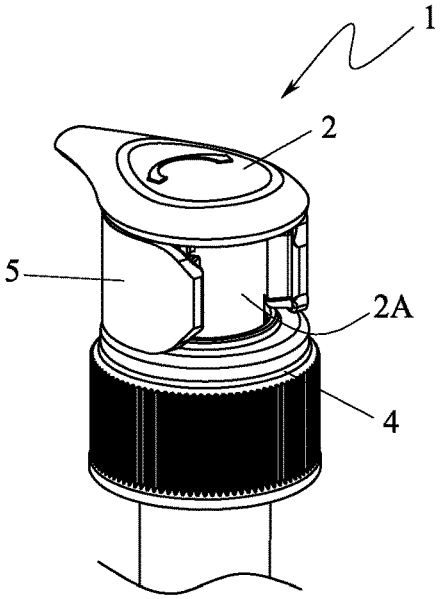
FIG. 2 is a rear perspective view of the pump in FIG. 1, with a safety element coupled thereto.

The safety element 5 is shown, in position, in FIG. 2.

The safety element 5 is snap-fitted onto the main part of the pump, and more specifically, onto the cylindrical part 2A of the dispenser 2 by means of an opening 7 therein, so as to be interposed between at least one flat surface 6 of the dispenser 2 and the ring nut 4, thus preventing the dispenser moving closer to the ring nut in the event of an impact during transportation.

Indeed, the safety element 5 is a C-shaped open ring, with sufficient elasticity to be easily fitted onto and removed from the dispenser, as will be discussed below. Regarding this aspect, the safety element may be made as a single moulded piece of plastic, such as, for example: PET, PE, PP, POM, PBT, etc.

Figure 3:
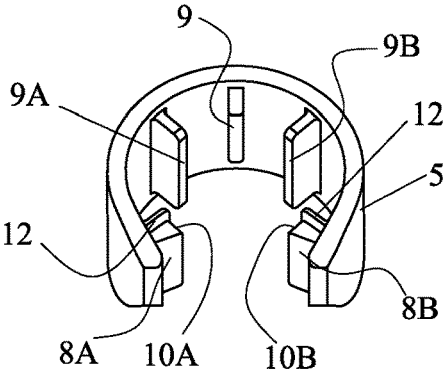
FIG. 3 is a front perspective view of solely the safety element in FIG. 2.
Figure 4:
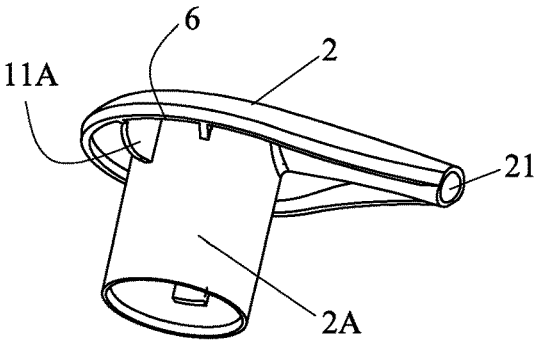
FIG. 4 is a view of solely the pump dispenser in FIG. 1.

As can be seen in FIG. 3, the safety element 5 features at least two ribs 8A, 8B, (which may also be simply thickened areas) which run parallel to the axis of the cylindrical part 2A of the dispenser (when the safety element is fitted onto the dispenser).

In the present description with the term 'rib' is intended a an 'area' that is thicker than the other parts of the security element close to the rib. The 'rib' can have sharp edges or it can be smoothed or chamfered to the parts of the security element close to the rib.

In the illustrated configuration there are three further ribs 9, 9A, and 9B, (or thickened areas) but there may be any number of ribs depending on the radial extension of the cylindrical part 2A.

Advantageously, the first rib 8A and the second rib 8B are positioned near the opening 7.

According to the invention, the main part of the pump comprises a first projection 11A and a second projection 11B, which are intended to cooperate respectively with the first rib 8A and the second rib 8B to limit or prevent rotation of the safety element 5 with respect to the main part of the pump.

As can be seen in the figure, the first and second projections may have a fin configuration and may protrude with respect to the plane to which the flat surface 6 belongs.

Figure 10:
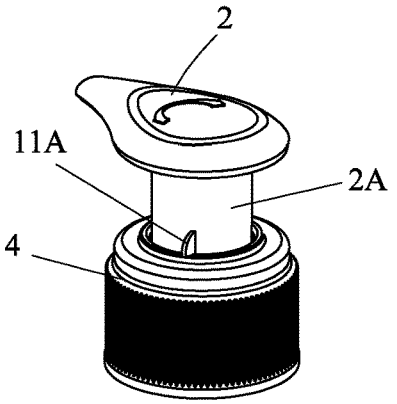
FIG. 10 is a possible variant of the pump in FIG. 1.

Obviously, the first and second projections may be made on either the dispenser 2 or the ring nut 4 (as can be seen in FIG. 10), or they may be made on both the dispenser and the ring nut.

For example, the first and second projections may extend from the dispenser towards the said ring nut, and/or from the ring nut towards the dispenser.

Advantageously, the first projection 11A and the second projection 11B are configured to cooperate with a step 12 or an abutment which extends from a free surface or base of each rib, near the opening 7 (i.e. of the first and second ribs).

Indeed, the steps and the projections cooperate precisely to limit or prevent rotation of the safety element 5 with respect to said main portion 2A.

Figure 7:
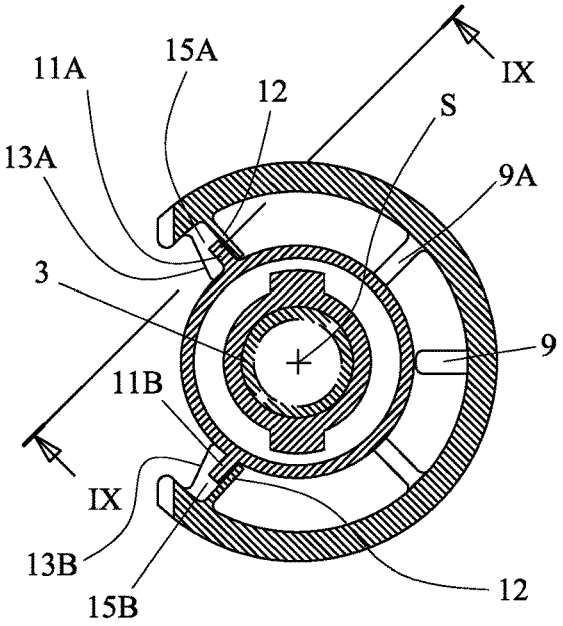
FIG. 7 is a section taken along line VII-VII of FIG. 6.

Obviously, the configuration and the mutual position of the steps and of the projections may be such that rotation of the safety element 5 is prevented entirely (in which case, in the resting position, both the projections are touching the steps, as in FIG. 7) or slight rotation of the safety element is enabled with respect to the ring nut (for example, 1-5°).

Advantageously, an angle that forms between the two abutment surfaces (with the relative projection) of the two steps 12 ranges from 100° to 80°, preferably from 90° to 80°, and even more preferably is 96°.

Consequently, also the angle between the abutment surfaces 11A, 11B (with the steps 12A, 12B) may have the same values as stated above.

As mentioned, it should be noted that the step 12 can extend from a base 15A, 15B (or free end) of each rib. Each projection 11A, 11B may be tall enough to strike the said base 15A, 15B (at least in the event of impacts with the dispenser 2) and therefore bend the dispenser at the rear, as will be better explained later on.

Figure 5:
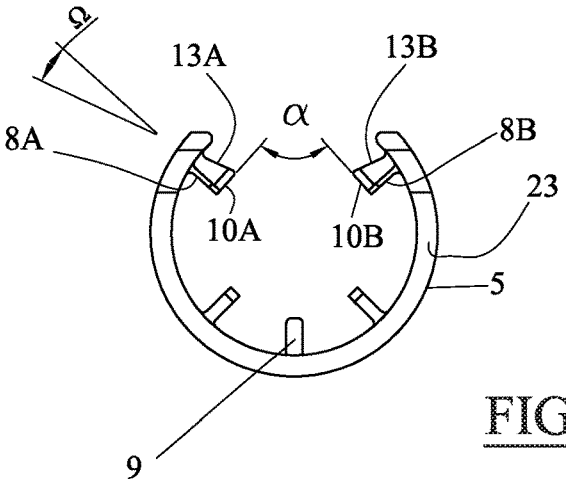
FIG. 5 is a plan view of the safety element in FIG. 3.

It can be seen from FIG. 5 that the first rib 8A and the second rib 8B may have, respectively, a first surface 10A and a second surface 10B touching the cylindrical part 2A, which form an angle $\alpha$ therebetween facing said cylindrical part 2A; this angle may range from 90° to 70°, preferably from 85° to 80°, and even more preferably is 84°. Obviously, all the aforesaid angles relating to the safety element 5 are calculated when the latter is in a non-deformed configuration, for example decoupled from the pump.

It has been established that these angles lend the safety element 5 excellent stability in the event of impacts.

This is because, in the event of an impact, the safety element deforms in an elastic manner and, since the rotation thereof is prevented or limited, the contact surfaces 10A, 10B (which are extended, partly due to the particular angle of the surfaces 13A and 13B) bring the said safety element back into position over the cylindrical part 2A of the dispenser, minimising the risk of the latter coming off.

Advantageously, the safety element 5 is configured so as not to undergo elastic deformation once fitted (or resting) onto the cylindrical part 2A.

Therefore, the ribs do not exert any more than a slight force on the cylindrical part of the dispenser and it has been established that this configuration minimises the risks of the safety element on the dispenser flying off (in the event of impacts).

To facilitate assembly of the safety element, the first rib 8A and the second rib 8B may each feature an invitation surface 13A, 13B which is inclined to promote the elastic deformation of the safety element 5 when fitted onto the cylindrical part 2A (widening the opening 7).

Figure 8:
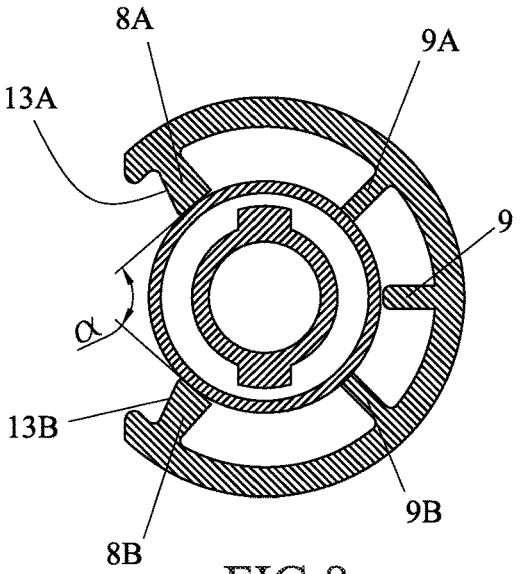
FIG. 8 is a section taken along line VIII-VIII of FIG. 6.

Upon examination of FIG. 8, it can be seen that the first rib 8A and the second rib 8B may feature a main section with a greater surface area than that of the other ribs 9 featured on the safety element 5. In fact, the first and second ribs are those which experience most stress during an impact, and a larger section means they can withstand any further impacts without breaking.

The greater section of the first and second ribs is also due to the particular inclination $\Omega$ of each of the invitation surfaces 13A, 13B with respect to a radius of the safety element 5. Advantageously, this inclination $\Omega$ ranges from 10° to 30°, preferably 17°, and can result in each rib having a trapezoidal section.

The trapezoid may be of the rectangle type, like the one shown, with a larger base at the contact surfaces 10A, 10B.

Also, to improve the coupling of the safety element 5 with the main part of the pump, the latter may feature further invitation surfaces, suitable for facilitating the wedging of the safety element 5 between the ring nut 4 and the dispenser 2, during an assembly phase.

Figure 6:
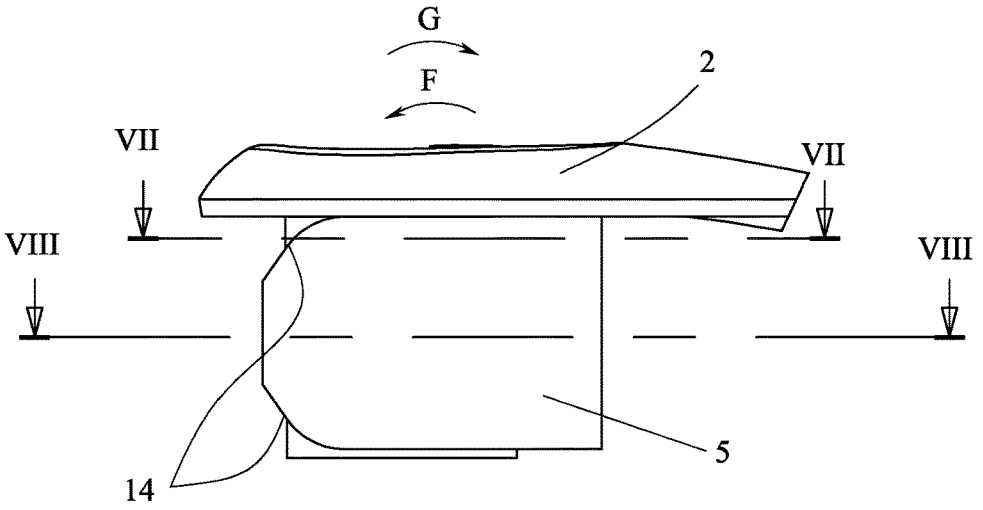
FIG. 6 is a side view of the safety element fitted onto the dispenser.
Figure 9:
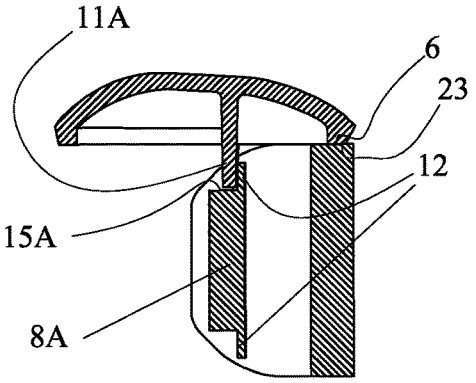
FIG. 9 is a partial, simplified section taken along line IX-IX of FIG. 7.

Upon comparative analysis of FIGS. 3, 7, and 9, it can be seen that the ribs 9, 9A, 9B may be lower than the free edge 23 of the safety element 5, so that solely the flat surface 6 of the dispenser is resting on the free edge 23 of the safety element (to counteract deflection in the direction shown by arrow G in FIG. 6).

The projections 11A and 11B are obviously useful in the event of impacts that impose strain on the dispenser resulting in deflection (for example, in the direction shown by arrow F); in this case, given the height thereof, each projection 11A, 11B strikes the base 15A, 15B of the said first rib 8A and/or second rib 8B so as to limit the onset of torque acting on an axis S of the stem 3.

The presence of the projections 11A, 11B, which strike the base 15A, 15B of the ribs, compensates for the fact that no support is provided for the dispenser at the opening 7 in the safety element 5.

It has been shown that the solution described, with a safety element 5 in the form of an interrupted ring, allows the said element to be simply inserted onto the drum (cylindrical part 2A) automatically and subsequently easily removed by the end user, prior to use.

Furthermore, the ring features a horizontal plane 23 which is suitable to counteract the dynamic load of a fall regardless of the angle.

It has also been shown that the presence of the projections 11A, 11B (cooperating with the ribs) limits or prevents rotation of the safety element around the axis of the cylindrical part 2A of the dispenser and counteracts at least the rear deflection (arrow F) in the said dispenser.

Various embodiments of the innovation have been disclosed herein, but further embodiments may also be conceived using the same innovative concept.

The invention claimed is:

1. Manual operated pump (1) for the delivery of a fluid, provided with a main part (2, 3, 4) comprising a dispenser (2) associated with a hollow shaft (3) of the pump, through which the fluid is supplied, and a ring nut (4) for fixing the pump to a container (20) configured to contain the fluid to be dispensed, the pump being provided with a safety element (5), configured to be snapped onto a cylindrical part (2A) of the dispenser through a safety element opening (7), so as to fit between at least one surface (6) of the dispenser (2) and the ring nut (4) thus preventing the dispenser from approaching the ring nut in the event of a collision during transport, the safety element (5) presenting at least one first (8A) and a second rib (8B) oriented parallel to the axis of the cylindrical part (2A) of the dispenser on which the safety element is fitted, said first (8A) and second (8B) rib, being positioned near said opening (7), characterized in that the main part of the pump comprises a first (11A) and a second projection (11B) designed to cooperate respectively with the first (8A) the second rib (8B) to limit or prevent the rotation of the safety element (5) with respect to the main part of the pump.

2. Pump according to claim 1, wherein the first (11A) and the second projection (11B) cooperate with a step (12) made on each of said first (8A) and second rib (8B) to limit or prevent the rotation of the safety element (5) with respect to said main portion, the step (12) extending from a base (15A, 15B) of each rib, each projection (11A, 11B) having a height such as to rest on said base (15A, 15B) at least in the event of impacts affecting the dispenser (2).

3. Pump according to claim 1, wherein the first (11A) and the second projection (11B) extend from the dispenser (2) in the direction of said ring nut (4) and/or wherein said first and second projection extend from said ring nut (4) in the direction of said dispenser (2).

4. Pump according to claim 1, wherein the first (8A) and the second rib (8B) have respectively a first (10A) and a second surface (10B) of contact with the cylindrical part (2A) reciprocally angled of an angle ($\alpha$) between 90° and 70°.

5. Pump according to claim 1, wherein each of the first (8A) and the second rib (8B) have a sloping surface (13A, 13B) inclined to help the elastic deformation of the safety element (5) when it is being fitted on the cylindrical part (2A), so as to widen its opening (7), the inclination ($\Omega$) of the invitation surface (13A, 13B) with respect to a radius of the safety element (5) being between 10° and 30°.

6. A pump as claimed in claim 1, wherein the first (8A) and the second rib (8B) have a main section of an area that is greater than that of other ribs (9) present on the safety element (5), and/or in which this section is trapezoidal, with a larger base facing said cylindrical part (2A).

7. Pump according to claim 1, wherein the safety element (5) has further invitation surfaces (14), configured to help the positioning of the safety element (5) between the ring nut (4) and the dispenser (2), during an assembly phase.

8. Pump according to claim 1, wherein the safety element (5) has three ribs and/or wherein the ribs have a lowered profile, with respect to the free edge (23) of the safety element (5).

9. Pump according to claim 1, wherein, when the safety element (5) is fitted on the cylindrical part (2A), it is free of elastic deformation.

10. Manual operated pump (1) for the delivery of a fluid, provided with a main part (2, 3, 4) comprising a dispenser (2) associated with a hollow shaft (3) of the pump, through which the fluid is supplied, and a ring nut (4) for fixing the pump to a container (20) configured to contain the fluid to be dispensed, the pump being provided with a safety element (5), configured to be snapped onto a cylindrical part (2A) of the dispenser through a safety element opening (7), so as to fit between at least one surface (6) of the dispenser (2) and the ring nut (4) thus preventing the dispenser from approaching the ring nut in the event of a collision during transport, the safety element (5) presenting at least one first (8A) and a second rib (8B) oriented parallel to the axis of the cylindrical part (2A) of the dispenser on which the safety element is fitted, said first (8A) and second (8B) rib, being positioned near said opening (7), characterized in that the main part of the pump comprises a first (11A) and a second projection (11B) designed to cooperate respectively with the first (8A) the second rib (8B) to limit or prevent the rotation of the safety element (5) with respect to the main part of the pump; wherein the pump (1) is in an extended stroke position when the safety element (5) is engaged.

* * * * *